US012264826B2

(12) United States Patent
Gao et al.

(10) Patent No.: US 12,264,826 B2
(45) Date of Patent: Apr. 1, 2025

(54) AIR CONDITIONER

(71) Applicant: QINGDAO HISENSE HITACHI AIR-CONDITIONING SYSTEMS CO., LTD., Shandong (CN)

(72) Inventors: Wendong Gao, Shandong (CN); Qingjie Wang, Shandong (CN); Xiaonan Gai, Shandong (CN)

(73) Assignee: QINGDAO HISENSE HITACHI AIR-CONDITIONING SYSTEMS CO., LTD., Qingdao (CN)

( * ) Notice: Subject to any disclaimer, the term of this patent is extended or adjusted under 35 U.S.C. 154(b) by 249 days.

(21) Appl. No.: 18/131,661

(22) Filed: Apr. 6, 2023

(65) Prior Publication Data

US 2023/0243522 A1 Aug. 3, 2023

Related U.S. Application Data

(63) Continuation-in-part of application No. PCT/CN2021/103530, filed on Jun. 30, 2021.

(30) Foreign Application Priority Data

Dec. 29, 2020 (CN) ..... 202023243472.X
Jun. 25, 2021 (CN) ..... 202110713126.3

(51) Int. Cl.

| | |
|---|---|
| ***F24F 1/12*** | (2011.01) |
| ***F24F 1/40*** | (2011.01) |
| ***F24F 11/86*** | (2018.01) |
| ***F24F 13/20*** | (2006.01) |
| ***F24F 13/24*** | (2006.01) |
| *F24F 110/10* | (2018.01) |

(52) U.S. Cl.

CPC ..... *F24F 1/12* (2013.01); *F24F 1/40* (2013.01); *F24F 11/86* (2018.01); *F24F 13/20* (2013.01);

(Continued)

(58) Field of Classification Search

CPC ..... F24F 1/12; F24F 1/40; F24F 11/86; F24F 13/20; F24F 13/24; F24F 2013/202; F24F 2013/242; F24F 2013/245; F24F 2110/10

See application file for complete search history.

(56) References Cited

U.S. PATENT DOCUMENTS 7,131,287 B2 * 11/2006 Uselton ..... F25B 41/40 181/207
2006/0048535 A1 3/2006 Uselton
2016/0282026 A1 9/2016 Park

FOREIGN PATENT DOCUMENTS

CN 201121969 Y 9/2008
CN 202418373 U 9/2012

(Continued)

OTHER PUBLICATIONS

CN 110186121 (English Translation) (Year: 2019).*

(Continued)

*Primary Examiner* — Jonathan Bradford
(74) *Attorney, Agent, or Firm* — MH2 TECHNOLOGY LAW GROUP LLP

(57) ABSTRACT

An air conditioner includes an indoor unit and an outdoor unit. The outdoor unit includes a housing, a compressor, a first damping member, and a second damping member. The compressor is provided with a pipe. The first damping member and the second damping member each are disposed on the pipe. The second damping member is located at a preset position of the pipe. The first damping member and the second damping member are configured to change a natural resonant frequency of the pipe to a target frequency. The second damping member includes a housing assembly and a clamping groove. The clamping groove is disposed on a side of the cavity proximate to the pipe, so that a center of (Continued)

gravity of the second damping member deviates from a center of gravity of a portion of the pipe connected with the damping groove.

20 Claims, 7 Drawing Sheets

(52) U.S. Cl.
CPC ..... *F24F 13/24* (2013.01); *F24F 2013/202* (2013.01); *F24F 2013/242* (2013.01); *F24F 2013/245* (2013.01); *F24F 2110/10* (2018.01)

(56) References Cited

FOREIGN PATENT DOCUMENTS

| | | | |
|---|---|---|---|
| CN | 104266310 | A | 1/2015 |
| CN | 204664630 | U | 9/2015 |
| CN | 106016576 | A | 10/2016 |
| CN | 106091453 | A | 11/2016 |
| CN | 106705273 | A | 5/2017 |
| CN | 106774487 | A | 5/2017 |
| CN | 110118452 | A | 8/2019 |
| CN | 110185870 | A | 8/2019 |
| CN | 110185871 | A | 8/2019 |
| CN | 111397171 | A | 7/2020 |
| CN | 112833484 | A | 5/2021 |
| KR | 1020080065198 | A | 7/2008 |
| WO | 2013099164 | A1 | 7/2013 |

OTHER PUBLICATIONS

International Search Report and Written Opinion dated Sep. 29, 2021 in corresponding International Application No. PCT/CN2021/103530, translated, 19 pages.

Chinese First Office Action dated Jun. 29, 2023 in corresponding Chinese Application No. 202110713126.3, translated, 21 pages.

* cited by examiner

AIR CONDITIONER

CROSS-REFERENCE TO RELATED APPLICATIONS

This application is a continuation-in-part application of International Application No. PCT/CN2021/103530, filed on Jun. 30, 2021, which claims priorities to Chinese Patent Application No. 202023243472.X, filed on Dec. 29, 2020, and Chinese Patent Application No. 202110713126.3, filed on Jun. 25, 2021, which are incorporated herein by reference in their entireties.

TECHNICAL FIELD

The present disclosure relates to the field of air conditioning technologies, and in particular, to an air conditioner.

BACKGROUND

With an advancement of science and technology and an improvement of people's living standards, air conditioners have gradually entered people's life and become an indispensable product in people's work and life. The air conditioner performs a cooling cycle or a heating cycle of the air conditioner by using a compressor, a condenser, an expansion valve, and an evaporator.

SUMMARY

In an aspect, an air conditioner is provided. The air conditioner includes an indoor unit and an outdoor unit. The outdoor unit includes a housing, a compressor, a first damping member, and a second damping member. The compressor is disposed in the housing. The compressor is provided with a pipe. The first damping member is disposed on the pipe. The second damping member is disposed on the pipe and is located at a preset position of the pipe. The preset position is a portion of the pipe on which at least one of vibration or stress is concentrated. The first damping member and the second damping member are configured to change a natural resonant frequency of the pipe to a target frequency, and the target frequency is different from an operating frequency of the compressor operating at a high frequency. The second damping member includes a housing assembly and a clamping groove. The housing assembly includes a housing body, a closed cavity is provided in the housing body, and a damping material is filled in the cavity. The clamping groove is disposed on the housing assembly and is connected with the pipe. The damping groove is located on a side of the cavity proximate to the pipe, so that a center of gravity of the second damping member deviates from a center of gravity of a portion of the pipe connected with the damping groove.

In another aspect, an air conditioner is provided. The air conditioner includes an indoor unit, an outdoor unit, and a controller. The outdoor unit includes a compressor, a first damping member, and a second damping member. The compressor is provided with a pipe. The first damping member is disposed on the pipe, and the second damping member is disposed on the pipe. The first damping member and the second damping member are configured to change a natural resonant frequency of the pipe to a target frequency. The target frequency is different from an operating frequency of the compressor operating at a high frequency. The controller is connected with the compressor, and the controller is configured to: determine a current operating mode of the air conditioner and whether a wind speed level of the air conditioner is within a preset level range; if it is determined that the air conditioner is operating in a heating mode and the wind speed level is within the preset level range, increase an operating frequency of the compressor, and control the compressor to skip a preset frequency range to operate at a first preset frequency; and, if it is determined that the air conditioner is operating in a cooling mode, or the wind speed level is outside the preset level range, control the compressor to operate at a second preset frequency. The target frequency is within the preset frequency range. The first preset frequency is greater than any value within the preset frequency range, and the second preset frequency is less than any value within the preset frequency range.

BRIEF DESCRIPTION OF THE DRAWINGS

In order to describe technical solutions in the present disclosure more clearly, the accompanying drawings to be used in some embodiments of the present disclosure will be introduced briefly. However, the accompanying drawings to be described below are merely some embodiments of the present disclosure, and a person of ordinary skill in the art may obtain other drawings according to these drawings. In addition, the accompanying drawings in the following description may be regarded as schematic diagrams, and are not limitations on actual sizes of products, actual processes of methods, and actual timings of signals to which the embodiments of the present disclosure relate.

DETAILED DESCRIPTION

Figure 1:
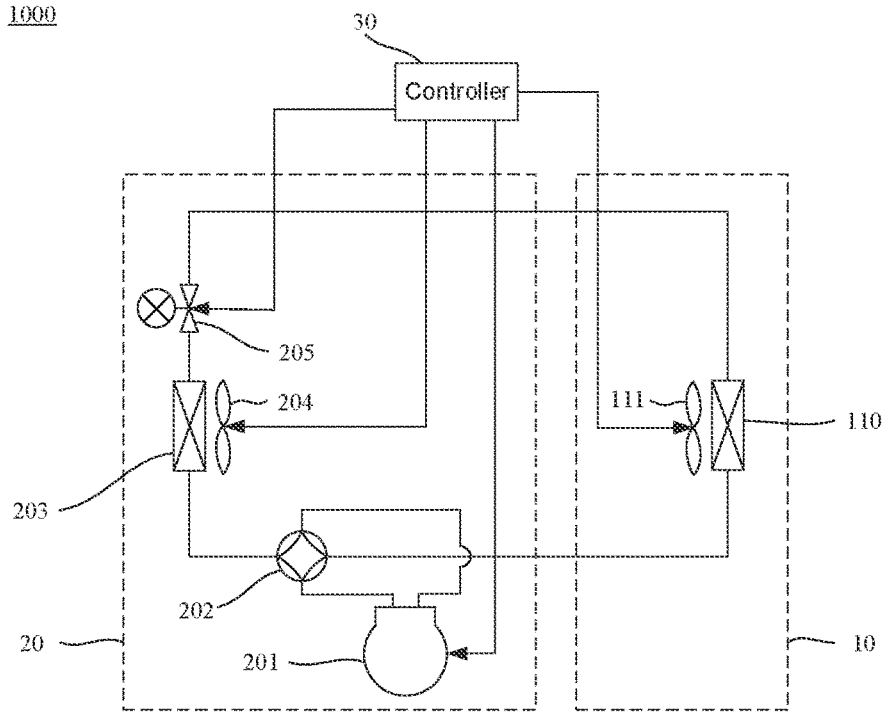
FIG. 1 is a schematic diagram of an air conditioner, in accordance with some embodiments.

Some embodiments of the present disclosure will be clearly and completely described below with reference to the accompanying drawings. However, the described embodiments are merely some but not all embodiments of the present disclosure. All other embodiments obtained by a person of ordinary skill in the art based on embodiments of the present disclosure shall be included in the protection scope of the present disclosure.

Unless the context requires otherwise, throughout the specification and the claims, the term "comprise" and other forms thereof such as the third-person singular form "comprises" and the present participle form "comprising" are construed as an open and inclusive meaning, i.e., "including, but not limited to." In the description of the specification, the terms such as "one embodiment," "some embodiments," "exemplary embodiments," "example," "specific example" or "some examples" are intended to indicate that specific features, structures, materials, or characteristics related to the embodiment(s) or example(s) are included in at least one embodiment or example of the present disclosure. Schematic representations of the above terms do not necessarily refer to the same embodiment(s) or example(s). In addition, the specific features, structures, materials, or characteristics may be included in any one or more embodiments or examples in any suitable manner.

Hereinafter, the terms such as "first" and "second" are used for descriptive purposes only and are not to be construed as indicating or implying the relative importance or implicitly indicating the number of indicated technical features. Thus, features defined by "first" or "second" may explicitly or implicitly include one or more of the features. In the description of the embodiments of the present disclosure, the term "a plurality of" or "the plurality of" means two or more unless otherwise specified.

In the description of some embodiments, the expressions "coupled," "connected," and derivatives thereof may be used. For example, the term "connected" may be used in the description of some embodiments to indicate that two or more components are in direct physical or electrical contact with each other. However, the term "connected" may also mean that two or more components are not in direct contact with each other but still cooperate or interact with each other. For another example, the term "coupled" may be used in the description of some embodiments to indicate that two or more components are in direct physical or electrical contact with each other. However, the term "coupled" or "communicatively coupled" may also mean that two or more components are not in direct contact with each other but still cooperate or interact with each other. The embodiments disclosed herein are not necessarily limited to the content herein.

The phrase "A and/or B" includes the following three combinations: only A, only B, and a combination of A and B.

As used herein, the term "if" is, optionally, construed as "when" or "in a case where" or "in response to determining that" or "in response to detecting," depending on the context. Similarly, depending on the context, the phrase "if it is determined that" or "if [a stated condition or event] is detected" is optionally construed as "in a case where it is determined that" or "in response to determining that" or "in a case where [the stated condition or event] is detected" or "in response to detecting [the stated condition or event]."

The use of the phase "applicable to" or "configured to" herein means an open and inclusive expression, which does not exclude devices that are applicable to or configured to perform additional tasks or steps.

The term such as "about," "substantially," and "approximately" as used herein includes a stated value and an average value within an acceptable range of deviation of a particular value. The acceptable range of deviation is determined by a person of ordinary skill in the art, considering measurement in question and errors associated with measurement of a particular quantity (i.e., limitations of a measurement system).

The term such as "parallel," "perpendicular," or "equal" as used herein includes a stated condition and a condition similar to the stated condition. A range of the similar condition is within an acceptable deviation range, and the acceptable deviation range is determined by a person of ordinary skill in the art, considering measurement in question and errors associated with measurement of a particular quantity (i.e., the limitations of a measurement system).

When a compressor in an air conditioner operates at a high frequency (e.g., in a range of 80 Hz to 110 Hz inclusive), the compressor vibrates greatly, and the vibration is transferred to a housing of an outdoor unit through a pipe connected with the compressor, causing the outdoor unit to vibrate to generate low frequency noise. Moreover, since an operating frequency of the compressor constantly changes, and the compressor inevitably resonates with the pipe in a certain frequency band to generate noise. Generally, a counterweight (i.e., a rubber block) may be provided on the pipe of the compressor to reduce a natural resonant frequency of the pipe. However, since the counterweight cannot dissipate the energy generated by vibration of the pipe, the pipe of the compressor is likely to be fractured by the stress of the vibration during the operation of the air conditioner. Dissipation of energy generated by vibration of the pipe may refer to that the kinetic energy generated by vibration of the pipe is converted to thermal energy or other energy, and the energy is gradually dissipated.

In order to solve the above problems, in some embodiments of the present disclosure, an air conditioner 1000 is provided.

FIG. 1 is a schematic diagram of an air conditioner, in accordance with some embodiments. As shown in FIG. 1, the air conditioner 1000 includes an indoor unit 10 and an outdoor unit 20. The indoor unit 10 is connected with the outdoor unit 20 by means of a pipe, so as to transport refrigerant. The indoor unit 10 includes an indoor heat exchanger 110 and an indoor fan 111. The outdoor unit 20 includes a compressor 201, a four-way valve 202, an outdoor heat exchanger 203, an outdoor fan 204, and an expansion valve 205. The compressor 201, the outdoor heat exchanger 203, the expansion valve 205, and the indoor heat exchanger 110 are connected in sequence, so as to form a refrigerant cycle. The refrigerant circulates in the refrigerant cycle and exchanges heat with the air through the outdoor heat exchanger 203 and the indoor heat exchanger 110, so as to achieve a cooling mode or a heating mode of the air conditioner 1000.

The compressor 201 is configured to compress the refrigerant, so as to make the refrigerant with a low pressure be compressed to be a refrigerant with a high pressure.

The outdoor heat exchanger 203 is configured to exchange heat between outdoor air and the refrigerant transported in the outdoor heat exchanger 203. For example, the outdoor heat exchanger 203 operates as a condenser in the cooling mode of the air conditioner 1000, so that the refrigerant compressed by the compressor 201 dissipates heat to the outdoor air through the outdoor heat exchanger 203 to condense. The outdoor heat exchanger 203 operates as an evaporator in the heating mode of the air conditioner 1000, so that the decompressed refrigerant absorbs heat from the outdoor air through the outdoor heat exchanger 203 to evaporate.

In some embodiments, the outdoor heat exchanger 203 further includes heat exchange fins, so as to expand a contact area between the outdoor air and the refrigerant transported in the outdoor heat exchanger 203, thereby improving heat exchange efficiency between the outdoor air and the refrigerant.

The outdoor fan 204 is configured to draw the outdoor air into the outdoor unit 20 through an outdoor air inlet of the outdoor unit 20 and exhaust the outdoor air after the outdoor air exchanges heat with the outdoor heat exchanger 203 through an outdoor air outlet of the outdoor unit 20. The outdoor fan 204 provides power for the flow of the outdoor air.

The expansion valve 205 is connected with the outdoor heat exchanger 203 and the indoor heat exchanger 110. A pressure of the refrigerant flowing through the outdoor heat exchanger 203 and the indoor heat exchanger 110 is regulated by an opening degree of the expansion valve 205, so as to regulate a flow rate of the refrigerant flowing between the outdoor heat exchanger 203 and the indoor heat exchanger 110. The flow rate and pressure of the refrigerant flowing between the outdoor heat exchanger 203 and the indoor heat exchanger 110 may affect the heat exchange performance of the outdoor heat exchanger 203 and the indoor heat exchanger 110. The expansion valve 205 may be an electronic valve. The opening degree of the expansion valve 205 is adjustable, so as to control the flow rate and pressure of the refrigerant flowing through the expansion valve 205. It will be noted that, some embodiments of the present disclosure will be given by considering an example in which the expansion valve 205 is disposed in the outdoor unit 20. Of course, in some embodiments, the expansion valve 205 may also be disposed in the indoor unit 10.

The four-way valve 202 is disposed in the refrigerant cycle and is configured to switch a flow direction of the refrigerant in the refrigerant cycle, so that the cooling mode or the heating mode may be performed by the air conditioner 1000.

The indoor heat exchanger 110 is configured to perform heat-exchange between indoor air and the refrigerant transported in the indoor heat exchanger 110. For example, the indoor heat exchanger 110 operates as an evaporator in the cooling mode of the air conditioner 1000, so that the refrigerant dissipated heat by the outdoor heat exchanger 203 absorbs heat from the indoor air through the indoor heat exchanger 110 to evaporate. The indoor heat exchanger 110 operates as a condenser in the heating mode of the air conditioner 1000, so that the refrigerant absorbed heat by the outdoor heat exchanger 203 dissipates heat into the indoor air through the indoor heat exchanger 110 to condense.

In some embodiments, the indoor heat exchanger 110 further includes heat exchange fins, so as to expand a contact area between the indoor air and the refrigerant transported in the indoor heat exchanger 110, thereby improving heat exchange efficiency between the indoor air and the refrigerant.

The indoor fan 111 is configured to draw the indoor air into the indoor unit 10 through an indoor air inlet of the indoor unit 10 and exhaust the indoor air after the indoor air exchanges heat with the indoor heat exchanger 110 through an indoor air outlet of the indoor unit 10. The indoor fan 111 provides power for the flow of the indoor air.

The air conditioner 1000 further includes a controller 30. The controller 30 is configured to control an operating frequency of the compressor 201, an opening degree of the expansion valve 205, a rotational speed of the outdoor fan 204, and a rotational speed of the indoor fan 111. The controller 30 is coupled with the compressor 201, the expansion valve 205, the outdoor fan 204, and the indoor fan 111 through data lines, so as to transmit communication information.

The controller 30 includes a processor. The processor may include a central processing unit (CPU), a microprocessor, or an application specific integrated circuit (ASIC), and the processor may be configured to execute the corresponding operations described in the controller 30 when the processor executes a program stored in a non-transitory computer-readable media coupled to the controller 30. The non-transitory computer-readable storage media may include a magnetic storage device (e.g., a hard disk, floppy disk, or magnetic tape), a smart card, or a flash memory device (e.g., an erasable programmable read-only memory (EPROM), a card, a stick, or a keyboard driver).

In some embodiments, the fan (e.g., the indoor fan 111 and the outdoor fan 204) in the air conditioner 1000 has a first mode and a second mode. In the first mode, the controller 30 may set a wind speed or an air quantity of the fan according to a preset program. The preset program may be stored in the non-transitory computer-readable media of the controller 30. In the second mode, users may set the wind speed or the air quantity of the fan through the air quantity or wind speed setting switch on a remote controller. It will be noted that the fan may have multiple different levels of wind speeds or air quantities. Herein, the level of the wind speed of the fan may be divided into a first wind speed, a second wind speed, a third wind speed, a fourth wind speed, and a fifth wind speed. The first wind speed, the second wind speed, the third wind speed, the fourth wind speed, and the fifth wind speed are arranged in ascending order. That is to say, the first wind speed represents the smallest wind speed.

The outdoor unit 20 according to some embodiments of the present disclosure will be described in detail below.

Figure 2:
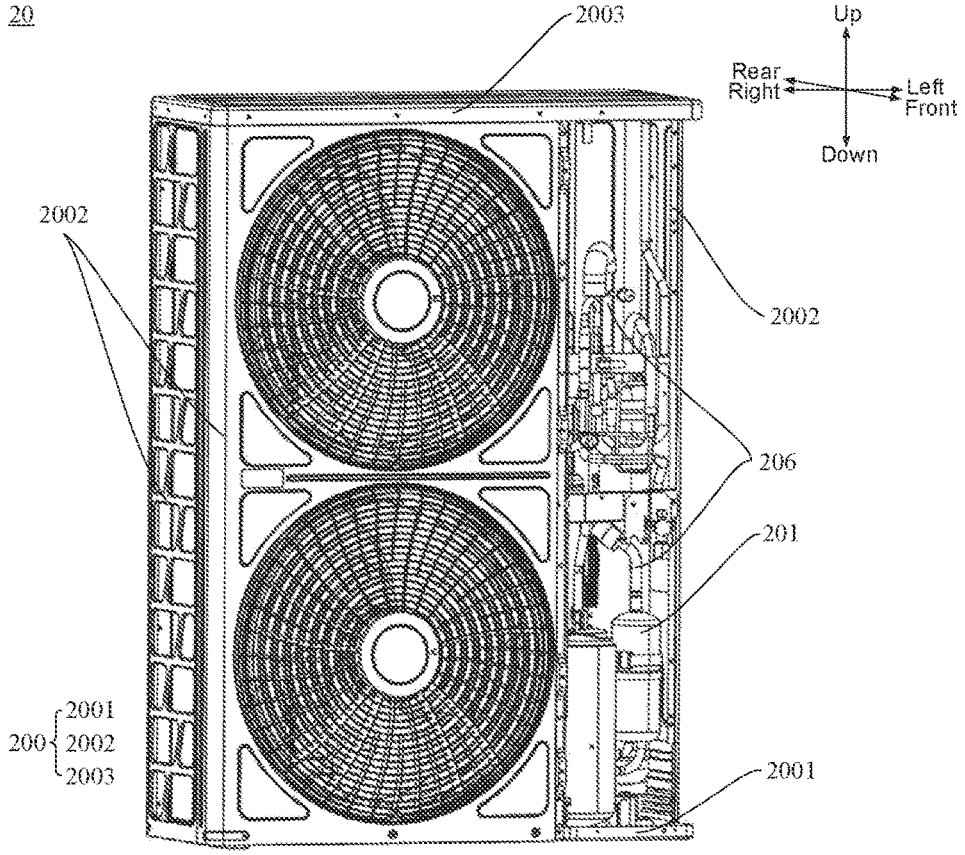
FIG. 2 is a diagram showing a structure of an outdoor unit in an air conditioner, in accordance with some embodiments.

FIG. 2 is a diagram showing a structure of an outdoor unit in an air conditioner, in accordance with some embodiments.

In some embodiments, as shown in FIG. 1 and FIG. 2, the outdoor unit 20 includes a housing 200, and a plurality of components (e.g., the compressor 201, the four-way valve 202, the outdoor heat exchanger 203, the outdoor fan 204, and the expansion valve 205) constituting the refrigerant cycle are disposed in the housing 200. For example, the housing 200 includes a base plate 2001, a plurality of side plates 2002, and a top plate 2003. The plurality of side plates 2002 are disposed on the base plate 2001 and are connected to each other. The top plate 2003 is disposed on a side (e.g., the upper side) of the plurality of side plates 2002 away from the base plate 2001, so that the top plate 2003 may form an accommodating space with the base plate 2001 and the plurality of side plates 2002. The accommodating space is used to accommodate the plurality of components that constitute the refrigerant cycle.

In some embodiments, the housing 200 further includes a connecting frame. The connecting frame is disposed on the base plate 2001 and is connected with the base plate 2001. The connecting frame is configured to connect the housing 200 to a wall, or to fix the housing 200 to a surface on which the housing 200 is placed. For example, the connecting frame includes a mounting plate. The mounting plate may be connected to a wall, so as to fix the housing 200.

It will be noted that, in a case where the air conditioner 1000 is a split air conditioner, the housing 200 may include a housing of the outdoor unit 20. Of course, in a case where the air conditioner 1000 is an integrated air conditioner, the housing 200 may also include an entire housing of the air conditioner 1000.

In some embodiments, as shown in FIG. 2, the compressor 201 is disposed in the housing 200. The compressor 201 is provided with a pipe 206. The compressor 201 may have one or more pipes 206. For example, the compressor 201 includes two pipes 206, and the two pipes 206 are connected with an air inlet and an air outlet of the compressor 201, respectively. The compressor 201, the expansion valve 205, the outdoor heat exchanger 203, and the indoor heat exchanger 110 are connected through the pipe 206, so as to form the refrigerant cycle of the air conditioner 1000.

The operating frequency of the compressor 201 is any value within a range of 30 Hz to 130 Hz inclusive. Moreover, the controller 30 may adjust the operating frequency of the compressor 201 according to the operating mode of the air conditioner 1000, the indoor temperature, the outdoor temperature, and the wind speed level of the fan, so as to match the operating mode of the air conditioner 1000, thereby saving energy consumption.

Figure 3:
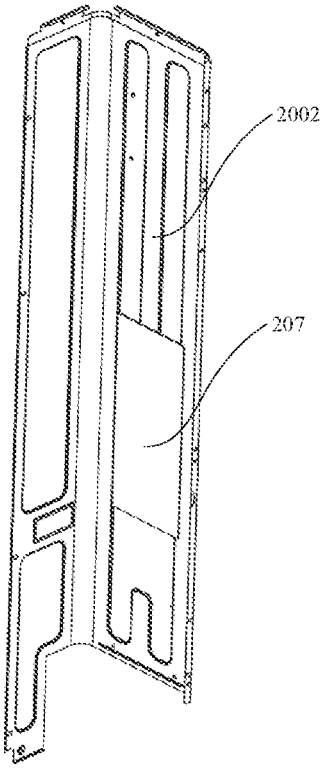
FIG. 3 is a diagram showing a structure of a side plate, in accordance with some embodiments.
Figure 4:
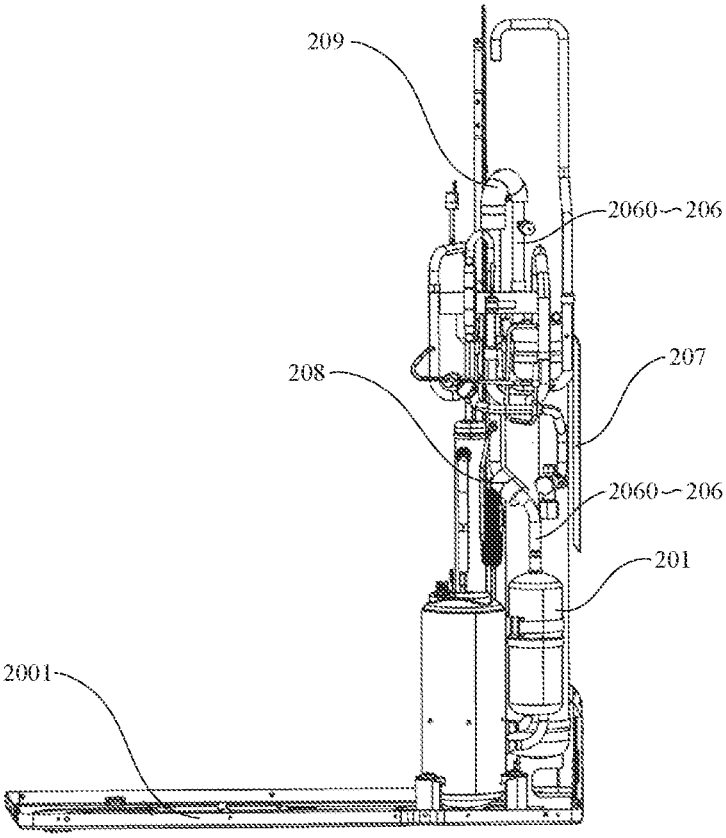
FIG. 4 is a diagram showing a partial structure of an outdoor unit without a housing, in accordance with some embodiments.

FIG. 3 is a diagram showing a structure of a side plate, in accordance with some embodiments, FIG. 4 is a diagram showing a partial structure of an outdoor unit without a housing, in accordance with some embodiments.

In some embodiments, as shown in FIGS. 3 and 4, the outdoor unit 20 further includes a damping pad 207. The damping pad 207 is disposed on the housing 200 and disposed adjacent to the pipe 206. The damping pad 207 is configured to reduce vibration transferred from the pipe 206 to the housing 200, so as to reduce noise generated by the vibration of the housing 200. For example, as shown in FIG. 3, the damping pad 207 is disposed on an inner wall of one of the side plates 2002, and the damping pad 207 is disposed adjacent to the pipe 206.

In some embodiments, the damping pad 207 may be oily clay, and the oily clay may consist of talcum powder, paraffin, and grease. For example, the damping pad 207 is the clay with a length of 300 mm, a width of 150 mm, and a thickness of 2 mm, and the weight of the clay is 201 g. In this way, the damping pad 207 may be matched with a portion of the pipe 206 closest to the one side plate 2002, so as to minimize the vibration transported from the pipe 206 to the housing 200.

In some embodiments, as shown in FIG. 4, the outdoor unit 20 further includes a first damping member 208 and a second damping member 209. The first damping member 208 and the second damping member 209 each are disposed on the pipe 206, so as to change the natural resonant frequency of the pipe 206 to a target frequency. The target frequency is within a preset frequency range. For example, in a case where the target frequency is 90 Hz, the preset frequency range is within a range of 88 Hz to 90 Hz inclusive.

Since the pipe 206 has a certain resonant frequency, the pipe 206 may vibrate when the operating frequency of the compressor 201 is consistent with the resonant frequency. By providing the first damping member 208 and the second damping member 209 on the pipe 206 of the compressor 201, the natural resonant frequency of the pipe 206 may be changed to the target frequency, so that the natural resonant frequency of the pipe 206 may bypass the operating frequency (e.g., a stable frequency) of the compressor 201 operating at a high frequency, so as to avoid the resonance of the pipe 206 caused by the compressor 201 operating at the high frequency.

In some embodiments, mass of the first damping member 208 is any value within a range of 300 g to 400 g inclusive, mass of the second damping member 209 is any value within a range of 150 g to 201 g inclusive. For example, the mass of the first damping member 208 is 300 g, 320 g, 340 g, 360 g, 380 g or 400 g, and the mass of the second damping member 209 is 150 g, 160 g, 175 g, 190 g, or 201 g.

It will be noted that, the first damping member 208 in the present disclosure adopts a solid structure while the second damping member 209 has a cavity, and the first damping member 208 and the second damping member 209 are made of the same material, thus the mass of the first damping member 208 is greater than the mass of the second damping member 209. The structures of the first damping member 208 and the second damping member 209 will be described later.

It can be understood that, in a case where the mass of the first damping member 208 is 360 g and the mass of the second damping member 209 is 175 g, the first damping member 208 and the second damping member 209 may change the natural resonant frequency of the pipe 206 from 95 Hz to 90 Hz (e.g., the target frequency). In a case where the air conditioner 1000 is operating in the heating mode, the compressor 201 operates at 95 Hz. In this case, the operating frequency (e.g., 95 Hz) of the compressor 201 is greater than the target frequency (e.g., 90 Hz). In this way, the compressor 201 will not cause vibration of the pipe 206 during operation.

In some embodiments, as shown in FIG. 4, the pipe 206 includes an intake pipe 2060, and the intake pipe 2060 is connected with an air inlet of the compressor 201. The first damping member 208 and the second damping member 209 each are disposed on the intake pipe 2060.

Figure 5:
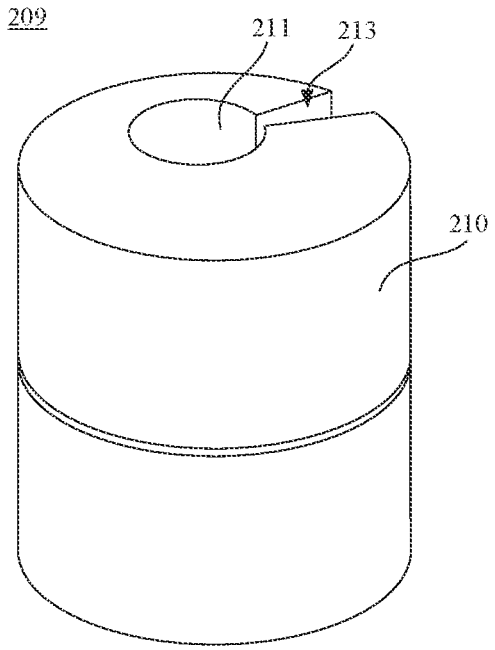
FIG. 5 is a diagram showing a structure of a second damping member, in accordance with some embodiments.
Figure 6:
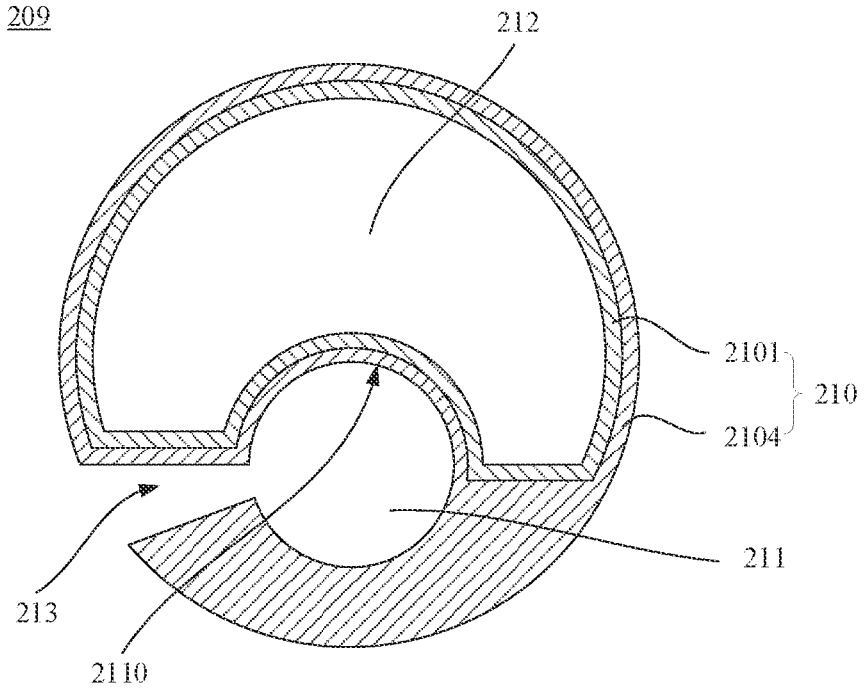
FIG. 6 is a sectional view of the second damping member in FIG. 5.
Figure 7:
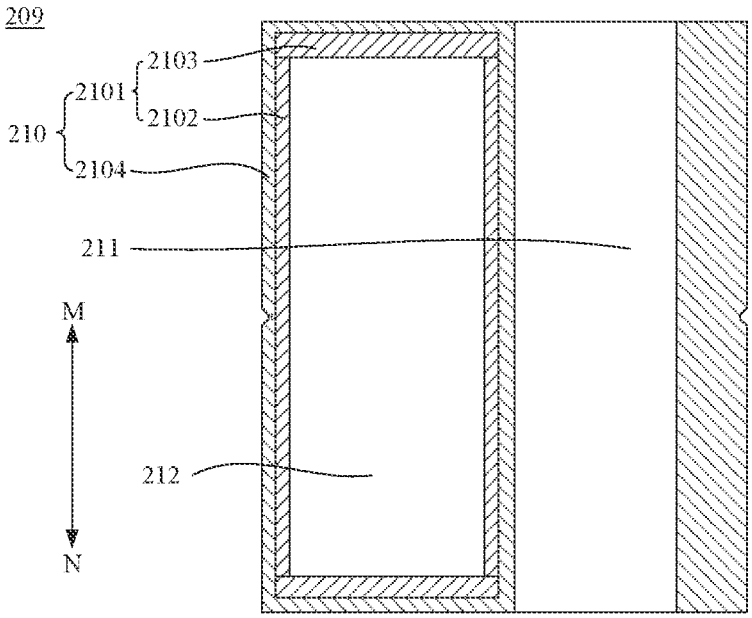
FIG. 7 is another sectional view of the second damping member in FIG. 5.

FIG. 5 is a diagram showing a structure of a second damping member, in accordance with some embodiments. FIG. 6 is a sectional view of the second damping member in FIG. 5. FIG. 7 is another sectional view of the second damping member in FIG. 5.

In some embodiments, as shown in FIGS. 5 to 7, the second damping member 209 includes a housing assembly 210 and a clamping groove 211. As shown in FIGS. 6 and 7, the housing assembly 210 includes a housing body 2101, a closed cavity 212 is disposed in the housing body 2101, and a damping material is filled in the cavity 212. During vibration of the second damping member 209 along with the pipe 206, the damping material may wobble randomly in the cavity 212, so as to dissipate vibration energy. In this way, the second damping member 209 may have an energy dissipation and vibration reduction function, thereby reducing the working noise of the air conditioner 1000 and improving the operation reliability of the air conditioner 1000.

The clamping groove 211 is disposed on the housing assembly 210, and the clamping groove 211 is proximate to the cavity 212 and extends in a height direction of the cavity 212 (e.g., the MN direction shown in FIG. 7). A side of the clamping groove 211 proximate to the pipe 206 is open, so as to form an opening 213 (referring to FIG. 6), and the pipe 206 is detachably connected with the clamping groove 211. For example, the pipe 206 is clamped with the clamping groove 211 through the opening 213, in this way, it is possible to facilitate the assembly and disassembly of the second damping member 209.

In some embodiments, as shown in FIG. 6, the clamping groove 211 is located on a side of the cavity 212 proximate to the pipe 206, so that a center of gravity of the second damping member 209 deviates from a center of gravity of a portion of the pipe 206 connected with the clamping groove 211. In this way, in a case where the second damping member 209 is mounted on the pipe 206, the center of gravity of the second damping member 209 does not coincide with the center of gravity of the portion of the pipe 206 connected with the second damping member 209, thereby further improving the energy dissipation and vibration reduction function of the clamping groove 211, and the centrifugal arrangement of the clamping groove 211 may also reduce the manufacturing difficulty.

In some embodiments, as shown in FIG. 6, an inner side wall 2110 of the clamping groove 211 has a circular arc shape, so as to match with the outer surface of the pipe 206. In this way, the inner side wall 2110 may wrap around the outer surface of the pipe 206, thereby increasing a contact area between the damping groove 211 and the pipe 206, and improving the vibration reduction and energy dissipation function of the second damping member 209.

In some embodiments, the damping material may be in a solid form, a liquid form, or a gaseous form. The damping material in the solid form includes grease, quartz sand, metal particles, ceramic particles, or rubber particles. Moreover, in a case where the damping material uses particles, a diameter of each particle is any value within a range of 0.6 mm to 5 mm. For example, the diameter of each particle is 0.6 mm, 0.8 mm, 1 mm, 1.5 mm, 2 mm, 3 mm, or 5 mm. The larger the diameter of each particle, the greater the noise produced by the damping material when the damping material is performing energy dissipation. If the diameter of each particle is too small, the damping effect of the damping material will be reduced. The damping material in the liquid form includes oil or water. The damping material in the gaseous form includes air (e.g., compressed air).

In some embodiments, a filling degree of the damping material filling cavity 212 (a ratio of a volume of the damping material to a volume of the cavity 212) may be any value within a range of 60% to 100%. For example, the damping material fills 60%, 70%, 80%, 95%, or 100% of the volume of the cavity 212. It will be noted that, a high filling degree may improve the damping effect of the damping material. However, a too high or too low filling degree may reduce the damping effect of the damping material.

In some embodiments, as shown in FIGS. 6 and 7, the housing assembly 210 further includes a wrapping layer 2104. The wrapping layer 2104 is wrapped outside the housing body 2101. In this case, the clamping groove 211 is disposed on the wrapping layer 2104 and is away from the cavity 212. The wrapping layer 2104 and the clamping groove 211 are a one-piece member for easy fabrication.

In some embodiments, as shown in FIG. 7, the housing body 2101 includes a sub-housing 2102 and a cover body 2103. A cavity 212 is formed in the sub-housing 2102, and the cover body 2103 is detachably connected with the sub-housing 2102. For example, the cover body 2103 covers the sub-housing 2102, so as to enclose the cavity 212, thereby facilitating filling and sealing the damping material.

By making the cover body 2103 be detachably connected with the sub-housing 2102, it may be possible to replace, increase, or reduce the damping material in the cavity 212, so that the natural resonant frequency of the pipe 206 may be changed as required.

In some embodiments, the second damping member 209 is movable on the pipe 206 (e.g., the intake pipe 2060). For example, the second damping member 209 moves up and down with respect to the intake pipe 2060. In this way, the second damping member 209 may vibrate along with the vibration of the intake pipe 2060 during the operation of the compressor 201, so as to effectively absorb or dissipate the vibration energy of the intake pipe 2060.

For example, in a case where the inner side wall 2110 of the damping groove 211 is in a circular arc shape, an inner diameter of the damping groove 211 is greater than an outer diameter of the pipe 206 (e.g., the intake pipe 2060), so that the second damping member 209 is movably connected with the pipe 206.

In some embodiments, the inner diameter of the clamping groove 211 is greater than an outer diameter of the intake pipe 2060 by any value within a range of 5 mm to 10 mm. For example, the inner diameter of the clamping groove 211 is 5 mm, 7 mm, 9 mm, or 10 mm greater than the outer diameter of the intake pipe 2060.

In some embodiments, the housing body 2101 is made of metal, plastic, or ceramic, and the housing body 2101 is resistant to high temperature, so as to avoid softening and deformation of the housing body 2101 within a range of 90° C. to 120° C. inclusive.

It will be noted that the greater the strength of the material of the housing body 2101 is, the thinner the thickness of the housing body 2101 may be. In a case where the material of the housing body 2101 is a metal plate, the thickness of the housing body 2101 is any value within a range of 0.4 mm to 1.0 mm. For example, the thickness of the housing body 2101 is 0.4 mm, 0.6 mm, 0.8 mm, or 1.0 mm. In a case where the material of the housing body 2101 is plastic, the thickness of the housing body 2101 is any value within a range of 0.8 mm to 1.5 mm. For example, the thickness of the housing body 2101 is 0.8 mm, 1.0 mm, 1.2 mm, 1.4 mm, or 1.5 mm.

In some embodiments, the wrapping layer 2104 may have the same material as that of the clamping groove 211. For example, the wrapping layer 2104 and the clamping groove 211 are made of rubber, or silica gel, so as to prevent the wrapping layer 2104 and the clamping groove 211 from corroding the pipe 206. Moreover, the wrapping layer 2104 and the clamping groove 211 are resistant to high temperature, so as to avoid softening and deformation of the housing body 2101 within a range of 80° C. to 110° C. inclusive. Of course, in some embodiments, the materials of the wrapping layer 2104 and the damping groove 211 may be different from each other.

Figure 8:
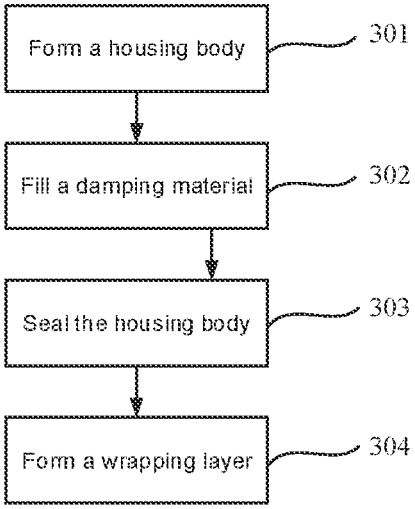
FIG. 8 is a flowchart of a manufacturing process of a second damping member, in accordance with some embodiments.

FIG. 8 is a flowchart of a manufacturing process of a second damping member, in accordance with some embodiments.

As shown in FIG. 8, in a case where the wrapping layer 2104 and the clamping groove 211 are a one-piece member, a manufacturing process of the second damping member 209 includes step 301 to step 304 (S301 to S304).

In step 301, the housing body 2101 is formed.

If the housing body 2101 is made of plastic, the sub-housing 2102 and the cover body 2103 may be manufactured through an injection molding process. If the housing body 2101 is made of a metal plate, the sub-housing 2102 and the cover body 2103 may be manufactured through a stamping process.

In step 302, the damping material is filled.

The damping material is filled into the cavity 212.

In step 303, the housing body 2101 is sealed.

The sub-housing 2102 and the cover body 2103 are sealed, so as to seal the damping material in the cavity 212.

In step 304, the wrapping layer 2104 is formed.

The housing body 2101 filled with the damping material is placed in a mold and is positioned, and then the wrapping layer 2104 and the clamping groove 211 are manufactured outside the housing body 2101 through the injection molding process.

In some embodiments of the present disclosure, by providing a separate housing body 2101 to contain and seal the damping material, it is convenient to manufacture the second damping member 209 and to seal the damping material.

Figure 9:
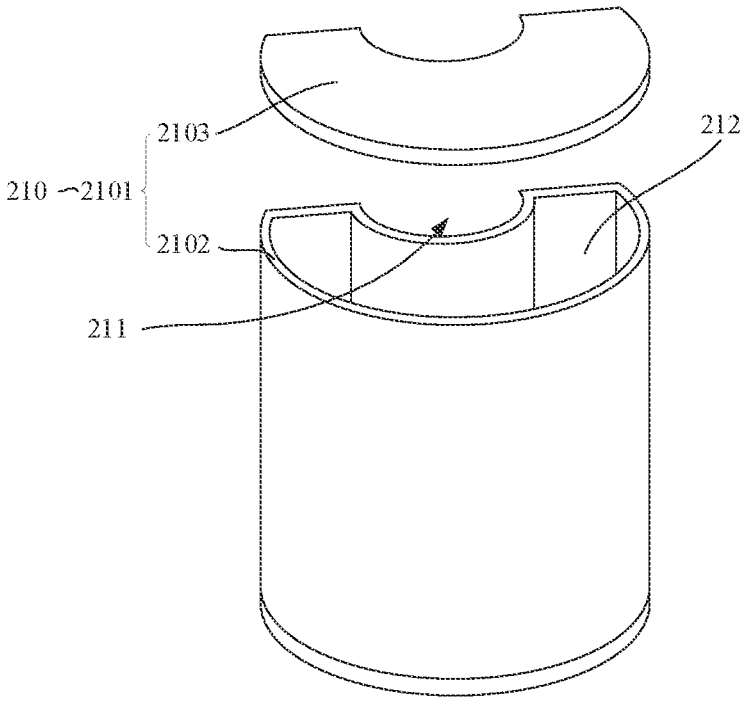
FIG. 9 is a diagram showing a structure of another second damping member, in accordance with some embodiments.
Figure 10:
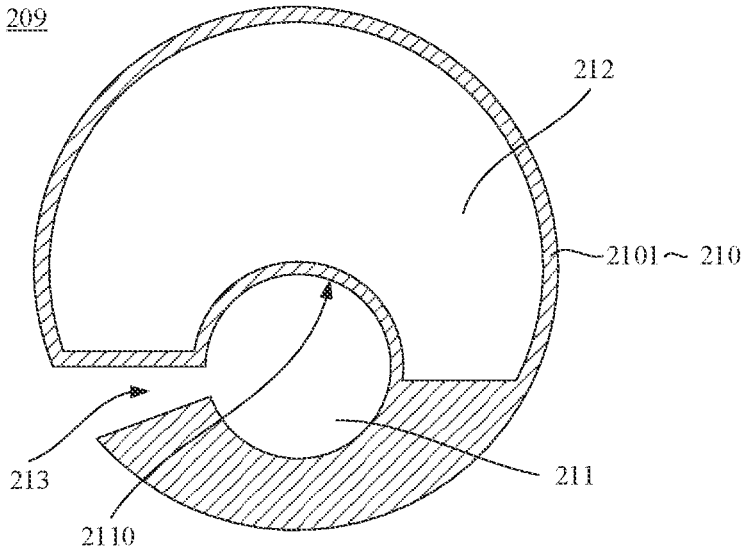
FIG. 10 is a sectional view of the second damping member in FIG. 9.
Figure 11:
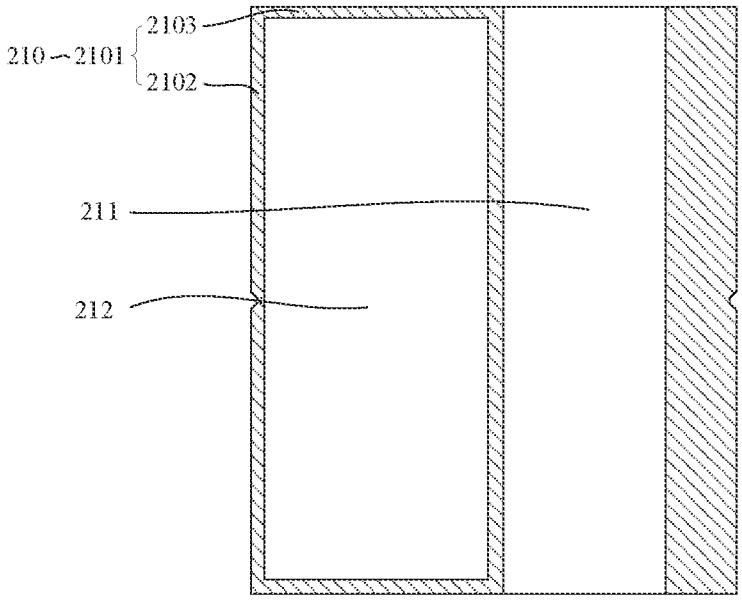
FIG. 11 is another sectional view of the second damping member in FIG. 9.

FIG. 9 is a diagram showing a structure of another second damping member, in accordance with some embodiments, FIG. 10 is a sectional view of the second damping member in FIG. 9. FIG. 11 is another sectional view of the second damping member in FIG. 9. Compared to FIG. 5, the second damping member 209 in FIG. 9 is not provided with the wrapping layer 2104.

In some embodiments, the housing assembly 210 may include only the housing body 2101, so as to simplify the processing steps. In this case, as shown in FIGS. 9 to 11, the damping groove 211 is disposed on the housing body 2101. For example, the housing body 2101 includes a sub-housing 2102 and a cover body 2103. The cover body 2103 is damped with the sub-housing 2102, so as to form a closed cavity 212. The damping groove 211 is disposed on the sub-housing 2102 and is proximate to the cavity 212. The damping groove 211 and the sub-housing 2102 are a one-piece member.

Figure 12:
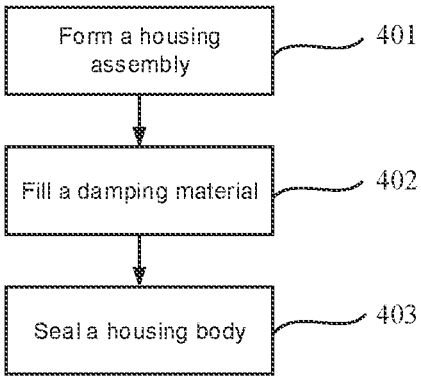
FIG. 12 is a flowchart of a manufacturing process of another second damping member, in accordance with some embodiments.

FIG. 12 is a flowchart of a manufacturing process of another second damping member, in accordance with some embodiments.

In some embodiments, the materials of the sub-housing 2102, the cover body 2103, and the damping groove 211 are the same. For example, the sub-housing 2102, the cover body 2103, and the clamping groove 211 are made of rubber or silica gel, and the sub-housing 2102 and the clamping groove 211 are a one-piece member.

In this case, as shown in FIG. 12, the manufacturing process of the second damping member 209 includes step 401 to step 403 (S401 to S403).

In step 401, the housing assembly 210 is formed.

The housing assembly 210 is made of rubber or silica gel, and the cover body 2103 and an overall structure of the sub-housing 2102 and the clamping groove 211 each are manufactured through an injection molding process.

In step 402, the damping material is filled.

The damping material is filled into the cavity 212.

In step 403, the housing body 2101 is sealed.

The sub-housing 2102 and the cover body 2103 are sealed, so as to seal the damping material in the cavity 212.

Since the second damping member 209 is not provided with the wrapping layer 2104, compared with the manufacturing process of the second damping member 209 described above, the manufacturing process of the second damping member 209 without the wrapping layer 2104 is simplified, and the cost is reduced.

Of course, in some embodiments, the materials of the sub-housing 2102, the cover body 2103, and the clamping groove 211 may be different from each other.

In some embodiments, the first damping member 208 is fixed on the pipe 206 and is a solid structure.

Since the second damping member 209 filled with the damping material has a good vibration reduction and energy dissipation function, among the two damping members, the vibration energy of the pipe 206 may be effectively dissipated by arranging one of the two damping members as the structure of the second damping member 209 to reduce the cost.

In addition, the second damping member 209 is disposed at a preset position of the pipe 206. The preset position refers to a portion (e.g., a bending position) of the pipe 206 on which at least one of the vibration or the stress is concentrated. In this way, it may be possible to make full use of the vibration reduction and energy dissipation function of the second damping member 209, so as to improve the vibration reduction and energy dissipation efficiency of the second damping member 209.

Of course, in some embodiments, the structure of the first damping member 208 may also be similar to that of the second damping member 209.

Some embodiments of the present disclosure further provide an air conditioner. A structure of the air conditioner is similar to the structure of the air conditioner 1000. The air conditioner includes the indoor unit 10, the outdoor unit 20, and the controller 30. The outdoor unit 20 includes a compressor 201, a first damping member 208, and a second damping member 209. The compressor 201 is provided with a pipe 206, and the first damping member 208 and the second damping member 209 are disposed on the pipe 206 connected with the compressor 201, so as to change the natural resonant frequency of the pipe 206 to a target frequency. For a relationship among the compressor 201, the first damping member 208, the second damping member 209, and the pipe 206, reference may made to the above related description, and details will not be repeated herein.

Figure 13:
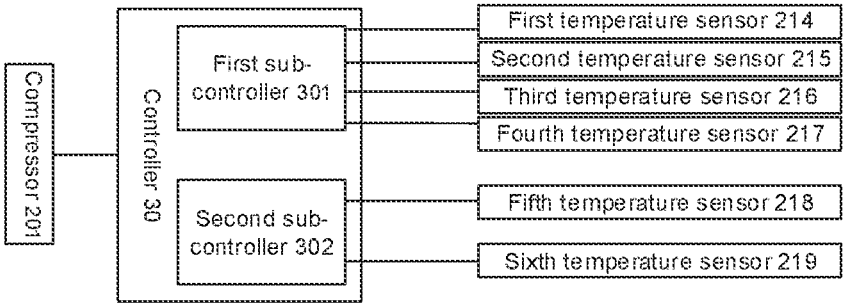
FIG. 13 a block diagram of a controller, in accordance with some embodiments.

FIG. 13 a block diagram of a controller, in accordance with some embodiments. As shown in FIG. 13, the controller 30 in the air conditioner includes a first sub-controller 301 and a second sub-controller 302. The first sub-controller 301 is located in the outdoor unit 20, and the second sub-controller 302 is located in the indoor unit 10. Moreover, the first sub-controller 301 and the second sub-controller 302 are connected through signal lines, and the first sub-controller 301 and the second sub-controller 302 may send signals to each other or receive signals from each other.

The first sub-controller 301 is configured to control operation of the compressor 201, an expansion valve 205, and an outdoor fan 204. For example, the outdoor unit 20 further includes a first temperature sensor 214, a second temperature sensor 215, a third temperature sensor 216, and a fourth temperature sensor 217. The first temperature sensor 214 is configured to detect a temperature of the outdoor air; the second temperature sensor 215 is configured to detect a temperature of the refrigerant flowing in an outdoor heat exchanger 203; the third temperature sensor 216 is configured to detect a temperature of the refrigerant discharged from the compressor 201; and the fourth temperature sensor 217 is configured to detect a temperature of the refrigerant in a gaseous form drawn by the compressor 201. Moreover, as shown in FIG. 13, the first sub-controller 301 is coupled with the first temperature sensor 214, the second temperature sensor 215, the third temperature sensor 216, and the fourth temperature sensor 217, so as to receive temperature signals detected by the plurality of temperature sensors.

The second sub-controller 302 is configured to control an indoor fan 111. For example, the indoor unit 10 further includes a fifth temperature sensor 218 (i.e., an indoor temperature sensor) and a sixth temperature sensor 219. The fifth temperature sensor 218 is configured to obtain a temperature of the indoor space in real time; and the sixth temperature sensor 219 is configured to detect a temperature of the refrigerant flowing in an indoor heat exchanger 110. Moreover, as shown in FIG. 13, the second sub-controller 302 is coupled with the fifth temperature sensor 218 and the sixth temperature sensor 219, so as to receive temperature signals detected by the plurality of temperature sensors.

It will be noted that the first sub-controller 301 and the second sub-controller 302 may also be a same controller, and the present disclosure is not limited thereto.

Figure 14:
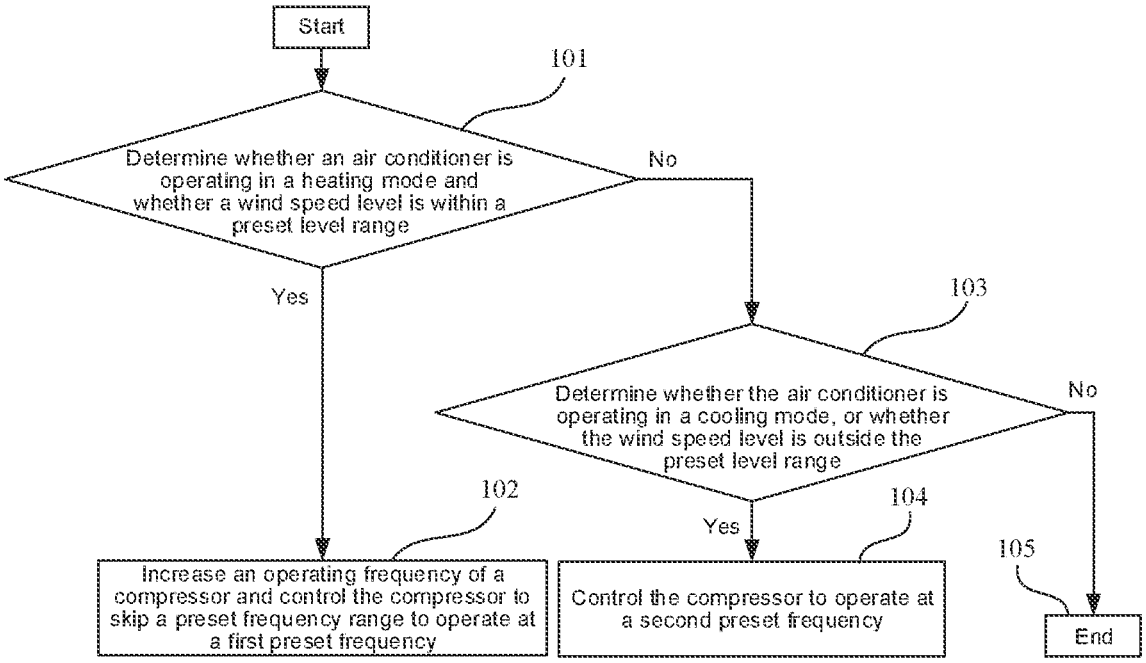
FIG. 14 is a flowchart of a control method of an air conditioner, in accordance with some embodiments.

FIG. 14 is a flowchart of a controller in an air conditioner, in accordance with some embodiments.

Referring to FIG. 14, the controller 30 of the air conditioner is configured to perform step 101 to step 105 (S101 to S105).

In step 101, the controller 30 determines whether the air conditioner is operating in a heating mode and whether a wind speed level is within a preset level range. If so, the controller 30 performs the step 102; if not, the controller 30 performs the step 103.

In step 102, the controller 30 increases an operating frequency of the compressor 201 and controls the compressor 201 to skip a preset frequency range to operate at a first preset frequency.

In step 103, the controller 30 determines whether the air conditioner is operating in a cooling mode, or whether the wind speed level is outside the preset level range. If so, the controller 30 performs the step 104; if not, the controller 30 performs the step 105.

In step 104, the controller 30 controls the compressor 201 to operate at a second preset frequency.

In step 105, the controller 30 ends the determination.

The target frequency is within the preset frequency range, and the target frequency is the natural resonant frequency of the pipe 206. The first preset frequency is greater than any value within the preset frequency range. The second preset frequency is less than any value within the preset frequency range. The wind speed level may refer to a wind speed level of a fan (e.g., an indoor fan 111 or an outdoor fan 204) in the air conditioner.

In a case where the air conditioner is operating in the heating mode, and the wind speed level of the fan in the air conditioner is within the preset level range, it is required that the operating frequency of the compressor 201 is increased to 95 Hz (e.g., the first preset frequency). In the process of increasing the operating frequency of the compressor 201, the operating frequency of the compressor 201 passes through the target frequency, resulting in resonance between the compressor 201 and the pipe 206. Therefore, in a case where the air conditioner is operating in the heating mode, and the wind speed level of the fan is within the preset level range, the controller 30 increases the operating frequency of the compressor 201, and makes the operating frequency of the compressor 201 skip or bypass the preset frequency range to the first preset frequency, so that the compressor 201 may skip the target frequency to operate in the process of increasing the operating frequency of the compressor 201 when the air conditioner is adjusting the indoor temperature to a first preset temperature. In this way, it may be possible to avoid a phenomenon that the pipe 206 vibrates due to a fact that the operating frequency of the compressor 201 is consistent with the target frequency of the pipe 206 in the process of increasing the operating frequency, which is conducive to reducing the noise generated by the pipe 206.

In a case where the air conditioner is operating in the cooling mode, or the wind speed level of the fan in the air conditioner is outside the preset level range, there is no need to increase the operating frequency of the compressor 201 to the first preset frequency to operate. Therefore, the second preset frequency may be less than the first preset frequency and may be less than any value within the preset frequency range. In this way, in a case where the air conditioner is operating in the cooling mode, or the wind speed level of the fan is outside the preset level range, the operating frequency of the compressor 201 may be different from the target frequency, thereby avoiding the resonance of the pipe 206 caused by the compressor 201. In this case, by increasing the operating frequency of the compressor 201 to the second preset frequency, it may be possible to not only make the air conditioner adjust the indoor temperature to the second preset temperature in the cooling mode, but also avoid the resonance of the pipe 206 caused by the compressor 201.

It will be noted that, the first preset temperature refers to an indoor temperature required by users in a case where the air conditioner is operating in the heating mode. The second preset temperature refers to an indoor temperature required by users in a case where the air conditioner is operating in the cooling mode.

In a case where the air conditioner is operating in the cooling mode, the outdoor heat exchanger 203 serves as a condenser and the indoor heat exchanger 110 serves as an evaporator. The refrigerant compressed by the compressor 201 dissipates heat to the outdoor air through the outdoor heat exchanger 203 to condense, and the refrigerant after dissipating heat through the outdoor heat exchanger 203 absorbs heat from the indoor air through the indoor heat exchanger 110 to evaporate.

In a case where the air conditioner is operating in the heating mode, the outdoor heat exchanger 203 serves as the evaporator, and an indoor heat exchanger 110 serves as the condenser. The refrigerant evaporates by absorbing heat from the outdoor air through the outdoor heat exchanger 203, and the refrigerant after absorbing heat through the outdoor heat exchanger 203 dissipates heat to the indoor air through the indoor heat exchanger 110 to condense.

In some embodiments, the preset frequency range is within a range of 88 Hz to 90 Hz inclusive. In a case where the pipe 206 is provided with the first damping member 208 and the second damping member 209, the compressor 201 generates noises within a range of 40 dB to 60 dB inclusive in different directions of the air conditioner when the operating frequency of the compressor 201 reaches to the range of 88 Hz to 90 Hz inclusive. Therefore, by making the compressor 201 skip the preset frequency range in the process of increasing the operating frequency of the compressor 201, it may be possible to reduce the noise when the air conditioner is operating.

In some embodiments, a difference between a maximum frequency and a minimum frequency in the preset frequency range may be less than or equal to a preset threshold, so as to avoid a phenomenon that the stability of the compressor 201 may be affected due to a large skipping value of the operating frequency in the process of increasing the operating frequency of the compressor 201. For example, the difference between the maximum frequency and the minimum frequency in the preset frequency range is less than or equal to 3 Hz.

Figure 15:
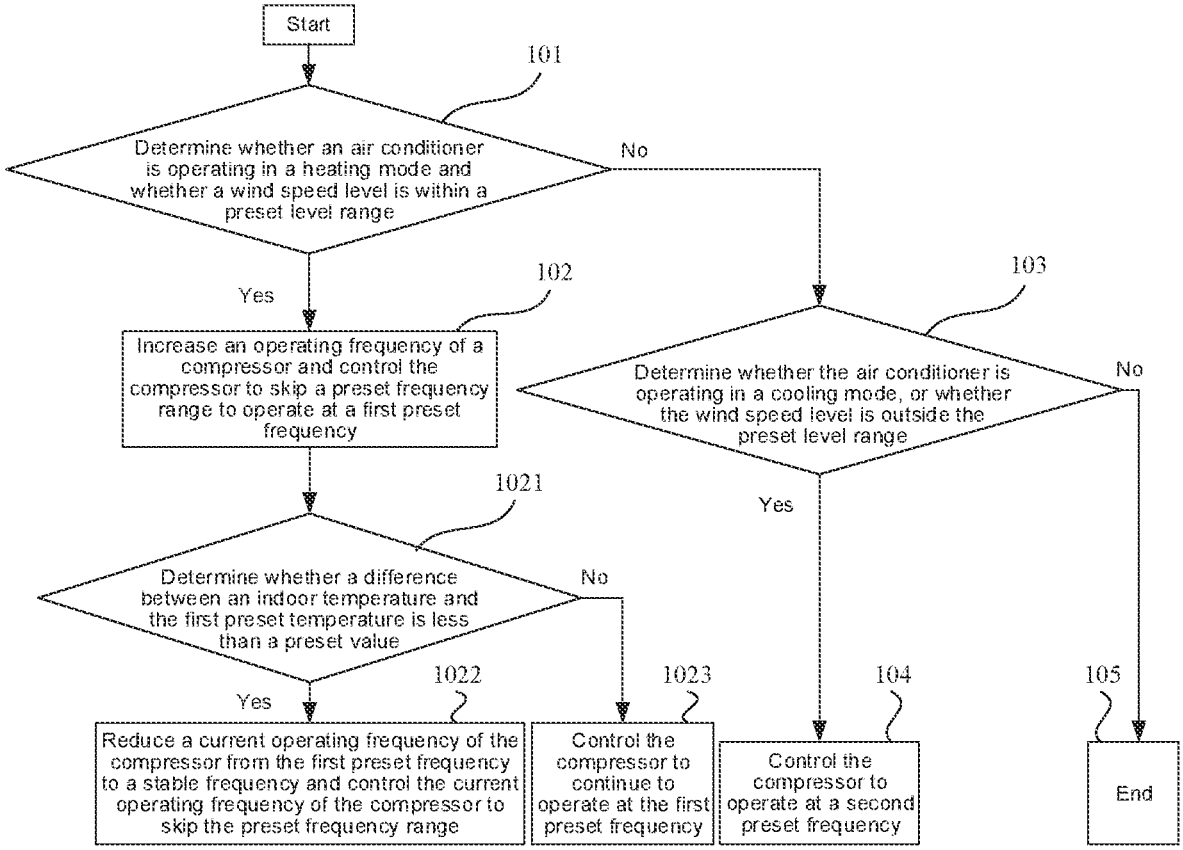
FIG. 15 is another flowchart of a control method of an air conditioner, in accordance with some embodiments.

FIG. 15 is another flowchart of a controller of an air conditioner, in accordance with some embodiments.

In some embodiments, as shown in FIG. 15, after the step 102, the controller 30 is further configured to perform step 1021 to step 1023 (S1021 to S1023).

In step 1021, the controller 30 determines whether a difference between the indoor temperature and the first preset temperature is less than a preset value. If so, the controller 30 performs the step 1022; if not, the controller 30 performs the step 1023.

For example, the controller 30 may detect the indoor temperature through the fifth temperature sensor 218.

In step 1022, the controller 30 reduces a current operating frequency of the compressor 201 from the first preset frequency to a stable frequency (i.e., a main operating frequency) and controls the current operating frequency of the compressor 201 to skip the preset frequency range.

In step 1023, the controller 30 controls the compressor 201 to continue to operate at the first preset frequency.

The stable frequency is less than any value within the preset frequency range.

After the operating frequency of the compressor 201 is increased to the first preset frequency, the indoor temperature rises to the first preset temperature due to the air conditioner. In this case, if the compressor 201 continues to operate at the first preset frequency, the indoor temperature will continue to rise, resulting in waste of electric energy. Therefore, when the indoor temperature rises to the first preset temperature, the controller 30 reduces the operating frequency of the compressor 201 to the stable frequency and controls the current operating mode of the air conditioner unchanged. Moreover, the compressor 201 operates at a certain high frequency to make the indoor temperature quickly reach the first preset temperature, and then the operating frequency of the compressor 201 is reduced to the stable frequency, which may also avoid a phenomenon that the load of each component in the air conditioner is too large due to the excessively high operating frequency of the compressor 201 and the entire unstable operation of the air conditioner.

It will be noted that, in the process of reducing the operating frequency of the compressor 201, the controller 30 controls the compressor 201 to skip the preset frequency range, so as to prevent the pipe 206 from resonating with the compressor 201. In a case where the indoor temperature does not reach the first preset temperature due to the air conditioner, the controller 30 controls the compressor 201 to continue to operate at the first preset frequency and controls the current operating mode of the air conditioner unchanged.

Moreover, the step performed by the controller 30 in some embodiments of the present disclosure may also be implemented by other hardware devices of the air conditioner, and the present disclosure is not limited thereto.

In the above description of the embodiments, specific features, structures, materials, or characteristics may be combined in a suitable manner in any one or more embodiments or examples.

A person skilled in the art will understand that the scope of disclosure in the present disclosure is not limited to specific embodiments discussed above, and may modify and substitute some elements of the embodiments without departing from the spirits of this application. The scope of this application is limited by the appended claims.

What is claimed is:

1. An air conditioner, comprising:

an indoor unit; and an outdoor unit, including:

a housing;

a compressor disposed in the housing, and the compressor being provided with a pipe;

a first damping member disposed on the pipe; and a second damping member disposed on the pipe and located at a preset position of the pipe, the preset position being a portion of the pipe on which at least one of vibration or stress is concentrated, the first damping member and the second damping member being configured to change a natural resonant frequency of the pipe to a target frequency, the target frequency being different from an operating frequency of the compressor operating at a high frequency, and the second damping member including:

a housing assembly including a housing body, wherein a closed cavity is provided in the housing body, and a damping material is filled in the cavity; and a clamping groove disposed on the housing assembly and connected with the pipe, wherein the clamping groove is located on a side of the cavity proximate to the pipe, so that a center of gravity of the second damping member deviates from a center of gravity of a portion of the pipe connected with the clamping groove.

2. The air conditioner according to claim 1, wherein the pipe includes an intake pipe, the intake pipe being connected with an inlet of the compressor, and the first damping member and the second damping member each being disposed on the intake pipe.

3. The air conditioner according to claim 1, wherein the second damping member is movably disposed on the pipe, so as to absorb vibration energy on the pipe.

4. The air conditioner according to claim 1, wherein the housing body includes:

a sub-housing, the sub-housing being provided with the cavity; and a cover body detachably connected with the sub-housing.

5. The air conditioner according to claim 4, wherein the housing assembly further includes a wrapping layer, the wrapping layer being wrapped outside the housing body, and the clamping groove being disposed on the wrapping layer.

6. The air conditioner according to claim 5, wherein the wrapping layer and the damping groove are a one-piece member.

7. The air conditioner according to claim 5, wherein the wrapping layer has a same material as the clamping groove.

8. The air conditioner according to claim 7, wherein the sub-housing and the cover body each are made of a metal, plastic, or ceramic, and the wrapping layer and the clamping groove each are made of rubber or silica gel.

9. The air conditioner according to claim 4, wherein the clamping groove is disposed on the housing body, and the clamping groove and the sub-housing are a one-piece member.

10. The air conditioner according to claim 9, wherein the sub-housing, the cover body, and the clamping groove are made of a same material.

11. The air conditioner according to claim 10, wherein the sub-housing, the cover body, and the clamping groove each are made of rubber or silica gel.

12. The air conditioner according to claim 1, wherein the pipe is detachably connected with the clamping groove.

13. The air conditioner according to claim 1, wherein the outdoor unit further includes:

a damping pad disposed on the housing and disposed adjacent to the pipe, and the damping pad being configured to reduce vibration transferred from the pipe to the housing, so as to reduce noise generated by vibration of the housing.

14. The air conditioner according to claim 13, wherein the damping pad is disposed on an inner side wall of the housing and is adjacent to the pipe.

15. The air conditioner according to claim 1, wherein the first damping member is a solid structure and is fixed on the pipe, and a mass of the first damping member is greater than a mass of the second damping member.

16. The air conditioner according to claim 15, wherein the mass of the first damping member is any value within a range of 300 g to 400 g inclusive, and the mass of the second damping member is any value within a range of 150 g to 201 g inclusive.

17. The air conditioner according to claim 1, wherein the damping material is in a solid, liquid, or gaseous form, and a filling degree of the damping material filling the cavity is any value within a range of 60% to 100% inclusive.

18. An air conditioner, comprising:

an indoor unit;

an outdoor unit, including:

a compressor provided with a pipe;

a first damping member disposed on the pipe; and a second damping member disposed on the pipe, the first damping member and the second damping member being configured to change a natural resonant frequency of the pipe to a target frequency, the target frequency being different from an operating frequency of the compressor operating at a high frequency; and a controller connected with the compressor, the controller being configured to:

determine a current operating mode of the air conditioner and whether a wind speed level of the air conditioner is within a preset level range;

if it is determined that the air conditioner is operating in a heating mode and the wind speed level is within the preset level range, increase an operating frequency of the compressor, and control the compressor to skip a preset frequency range to operate at a first preset frequency;

if it is determined that the air conditioner is operating in a cooling mode, or the wind speed level is outside the preset level range, control the compressor to operate at a second preset frequency; wherein the target frequency is within the preset frequency range, the first preset frequency is greater than any value within the preset frequency range, and the second preset frequency is less than any value within the preset frequency range.

19. The air conditioner according to claim 18, wherein the indoor unit includes an indoor temperature sensor, the indoor temperature sensor being configured to detect an indoor temperature, the controller being coupled with the indoor temperature sensor, and the controller being further configured to:

after the compressor operates at the first preset frequency, determine whether a difference between the indoor temperature and a first preset temperature is less than a preset value;

if it is determined that the difference between the indoor temperature and the first preset temperature is less than the preset value, reduce a current operating frequency of the compressor from the first preset frequency to a main operating frequency, and control the current operating frequency of the compressor to skip the preset frequency range;

if it is determined that the difference between the indoor temperature and the preset temperature is greater than or equal to the preset value, control the compressor to continue to operate at the first preset frequency; wherein the main operating frequency is less than any value within the preset frequency range, and the first preset temperature refers to an indoor temperature required in a case where the air conditioner is operating in the heating mode.

20. The air conditioner according to claim 18, wherein a difference between a maximum frequency and a minimum frequency in the preset frequency range is less than or equal to a preset threshold.

* * * * *